United States Patent [19]

Moller

[11] 4,199,050

[45] Apr. 22, 1980

[54] APPARATUS FOR THE PACKAGING OF COMESTIBLES AND THE LIKE, ESPECIALLY DAIRY PRODUCTS, IN CUP-SHAPED CONTAINERS

[75] Inventor: Erwin Möller, Wuppertal, Fed. Rep. of Germany

[73] Assignee: Hamba-Maschinenfabrik Hans A. Müller GmbH & Co. KG, Wuppertal-Vohwinkel, Fed. Rep. of Germany

[21] Appl. No.: 850,389

[22] Filed: Nov. 10, 1977

[30] Foreign Application Priority Data

Nov. 12, 1976 [DE] Fed. Rep. of Germany ... 7635747[U]

[51] Int. Cl.[2] ..... B65G 47/32

[52] U.S. Cl. ..... 198/429; 53/247; 198/432; 198/486; 294/87 R; 414/751

[58] Field of Search ..... 198/426, 428, 429, 430, 198/432, 486; 214/1 BB; 294/65, 87 R, 87 A; 53/247

[56] References Cited

U.S. PATENT DOCUMENTS

| | | | |
|---|---|---|---|
| 3,300,945 | 1/1967 | Grossi et al. | 53/247 |
| 3,448,865 | 6/1969 | Schroder | 214/1 BB |
| 3,860,280 | 1/1975 | Karlsson | 294/65 |
| 3,920,128 | 11/1975 | Baker | 294/65 |

*Primary Examiner*—Jeffrey V. Nase

*Attorney, Agent, or Firm*—Montague & Ross

[57] ABSTRACT

An apparatus for the packaging of comestibles and other materials in individual cup-shaped containers has a cup-discharge station at the end of a conveyor at which the filled cups are removed from respective receptacles in the conveyor. Individual lifting plates below the conveyor raise the cups into an array of grippers which are relatively displaceable in two mutually perpendicular directions so that, when the array is displaced from alignment with the lifter plates, the inter-cup spacing can be reduced.

15 Claims, 7 Drawing Figures

APPARATUS FOR THE PACKAGING OF COMESTIBLES AND THE LIKE, ESPECIALLY DAIRY PRODUCTS, IN CUP-SHAPED CONTAINERS

FIELD OF THE INVENTION

The present invention relates to a packaging apparatus for introducing comestibles and other substances into individual cup-shaped containers. More particularly, the invention relates to a system for removing filled cups from respective receptacles in a conveyor of a packaging machine.

BACKGROUND OF THE INVENTION

In the packaging of comestibles and other substances, e.g. dairy products, in a liquid or pasty or semi-pasty state in individual cup-shaped containers, it is a common practice to provide a continuous endless conveyor which is provided with cup receptables in parallel rows extending in the direction of displacement of the conveyor and transverse rows running perpendicular to this direction. At the discharge station along the path of the conveyor, a cup-removal device is provided and can comprise gripper means with grippers having two spreadable gripper halves which are relatively shiftable. Below the row of grippers, there is provided a lifting device for raising the cups out of the receptacles in the conveyer and into engagement with the grippers.

In an apparatus of this type, particularly for the packaging of dairy products in a liquid or semi-paste consistency, e.g. yogurt, the individual cups are inserted into the individual receptacles of the conveyor at a cup-supplying station. The cups are then carried stepwise through a pre-dosing station in which fruit or other materials may be initially added to the cups, e.g. in the case in which fruit yogurt is packaged. Thereafter, the cup is introduced into a main filling station in which the remainder of the filling is introduced into each cup, a cover-application station, a sealing station in which the cover is fastened in place, a printing station at which various indicia may be printed upon the package, e.g. to indicate the expiration of the shelf life thereof, and the cup-removal station described above.

The cup-supply station, the pre-dosing station, the main feeding station, the cover-application station and the printing station, as well as the sealing station, generally require mechanical elements for cooperation with the individual cups which occupy considerable space and, for each cup, may take up a cross section which is greater than the total cross section of the individual cup. In order to provide the space necessary to accommodate these elements, the cup-receiving receptacles in the individual cell plates of the conveyor must be fairly widely spaced apart. As a result, there is a considerable spacing around each of the cup-receiving receptacles and hence of the cups when they are disposed at the cup-discharge station.

In conventional apparatus, the finished cups should be made available in so-called blocks of, for example, twenty cups. In order to form such cup blocks, the grippers carry the individual cups to a conveyor at which the cup block can be introduced into a cardboard box, crate or holder or lifter. To this end, the conventional apparatus can include a lifting plate for raising the cup block holder onto the undersides of the cups while they are engaged from above by the grippers in a position which is offset from the cup-removal location above the conveyor. The grippers then can release the cups and the cup block can be deposited upon a conveyor for carrying the block away.

In the cup block, it is, of course, desirable that the spacing between the cups be as small as possible, i.e. that the cup block be as compact as possible.

Consequently, between the cup-pickup location and the cup-release location, the gripper arrangement must provide for a condensation of the array of cups to the cup block.

In the prior-art system, this is accomplished as follows:

At the discharge side of the conveyor, below the last row of filled and closed cups thereof, there are provided individual but interconnected cup lifters which raise only the single transverse row of cups into the respective grippers. The lifters are raised into a position in which they lie substantially flush with the upper surface of the cell plate of the conveyor so that the elevated cups can be retained and slide upon this surface. To retain the cups during their accumulation into a condensed array, an intermediate plate is provided onto which the cups can be shifted and the cups can be held in place by individual fork-shaped centering elements.

When the cups are provided in four rows on the conveyor parallel to the direction of displacement thereof, in five working strokes, five transverse rows of cups are shifted onto the intermediate plate in five strokes. This permits the cups to be brought extremely close together. When the cups of the cup block have been fully assembled, the grippers engage the cups by the lifting thereof into engagement with the grippers. The intermediate plate thus constitutes the means for lifting the cups into the open grippers. After the intermediate plate has been lowered, the grippers are displaced into a location offset from the pickup location and the holder of the lifter or carton can be emplaced upon the cup block.

The resulting apparatus requires considerable space, is relatively expensive to construct and operate, and has not proved to be fully satisfactory.

OBJECT OF THE INVENTION

It is the principal object of the present invention to improve upon existing apparatus of the character described and, more particularly, to provide an improved cup-removal means for a packaging machine of the class described which avoids the drawbacks of the earlier systems.

SUMMARY OF THE INVENTION

This object and others which will become apparent hereinafter are attained, in accordance with the present invention, by providing a cup-pickup and removal device which includes an array of cup lifters alignable with the receptacles in the cup-carrying conveyor and corresponding in number to the cups of the desired cup block to be formed. Above this array of cup lifters, there is provided, upon a movable holder frame, an array of grippers into which the cups are directly lifted. The rectangular array of grippers is then condensed, i.e. the grippers of the array are moved together in two mutually perpendicular directions to decrease the inter-cup spacing of the cups engaged by these grippers. Simultaneously or thereafter, the gripper array is shifted to a location offset from the pickup location and at which the cups can be deposited on a conveyor, e.g. after securing them in a cup holder or lifter.

In other words, the grippers in the system of the present invention are disposed directly above the conveyor and are aligned originally with the full array of cup receptacles corresponding to the number of cups in the rectangular array thereof to be constituted a cup block. The difference between this structure and the prior-art system mentioned previously is that it completely eliminates any kind of assembly platform or intermediate conveyor for the cups serving as their condensing means. The grippers themselves, in the system of the present invention, perform the closing up of the spacing between the cups.

While this means that the grippers, if they are to engage the cups directly as they are raised from the conveyor receptacles, must be somewhat elongated, this has not been found to be a problem and indeed is an advantage in that it reduces the overall size of the apparatus and the need for any means to temporarily retain the cups in an erect and properly positioned arrangement.

While in the conventional device, the grippers are displaceable only transverse to the feed direction of the conveyor, with the system of the present invention, the grippers are displaceable in two directions at right angles to one another relatively so that the array is condensed in both of these mutually perpendicular directions, i.e. parallel to the direction of displacement of the conveyor and transversely thereof.

In practice, the apparatus of the present invention has been found to reduce the manufacturing cost by eliminating the need for a separate cup-raising device or cup-accumulation or positioning elements. Of perhaps greater advantage, is the fact that the apparatus can have a reduced size and requires lower maintenance and like attentions.

It has been found to be advantageous to so construct the individual cup lifters that in their upper end positions, they lie somewhat above the upper surface of the conveyor. This permits the bottoms of the cups to be located somewhat above the conveyor when they are engaged by the gripper and ensures that the displacement of the cups will be free from any interference by the conveyor surfaces.

According to another feature of the invention, the back-and-forth movement of the grippers between the pickup and cup-discharge locations is effected by mounting the grippers on a holder frame which is itself horizontally displaced between the pickup location and the release location. This displacement can be at right angles to the feed direction of the conveyor. As a result, the apparatus can have an L configuration so as to be more readily accommodated in a given space in a packaging plant.

Because of the rectangular configuration of the cup blocks, it is possible, naturally, to use the L-shaped layout described previously or a layout in which the release location is aligned with the conveyor.

Another advantage of the system of the present invention is that it does not require accumulation of the cups row by row with individual operations for each row. Entire arrays of cups can be removed in a single operation.

The holder frame is advantageously vertically adjustable upon a transport carriage which can be horizontally displaceable upon the machine housing on appropriate rails or guides. To minimize the length of the apparatus required for displacing the frame and its carriage, this can be constituted by a motion-multiplying mechanism which can include a rack fixed to the machine housing, a rack disposed on the carriage and coplanar with the first-mentioned rack, and a pinion which meshes with both of these racks, the axis of this pinion being linearly displaceable, e.g. by a crank arrangement. As a result, the linear displacement of the axis of the pinion is multiplied by two on being transformed into a linear displacement of the carriage. The crank can be actuated most effectively by an electric motor driven by a respective transmission. This crank arrangement gives all of the advantages of crank kinematics, especially harmonic motion so that an effective reduction in speed at the end positions of the carriage can be obtained.

According to yet another feature of the invention, the holder frame is provided with guide bars running in both of the directions of displacement of the grippers and the gripper holders are mounted thereon so as to be displaced with lost motion upon engagement of one or another gripper by fluid-responsive actuating means. Each gripper holder is provided, moreover, with respective double-acting cylinders for controlling the two gripper halves which are moved toward and away from one another to open and close the grippers.

BRIEF DESCRIPTION OF THE DRAWING

The above and other objects, features and advantages of the present invention will become more readily apparent from the following description, reference being made to the diagrammatic drawing attached hereto and illustrating an apparatus in accordance with the principles of the present invention. In the drawing.

SPECIFIC DESCRIPTION

Figure 1:
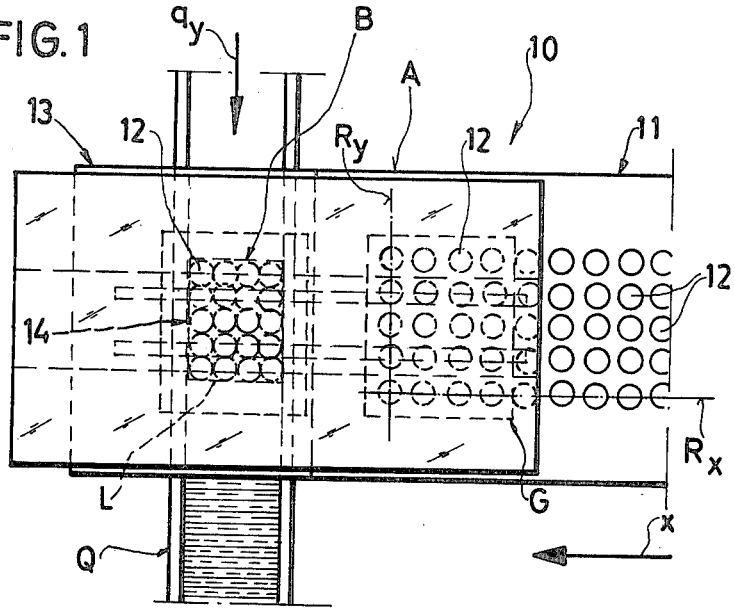
FIG. 1 is a schematic partial plan view of the apparatus.

The apparatus shown in the drawing is used for the filling of cup-shaped containers 12, hereinafter referred to generally as cups, with comestible or other materials, especially dairy products in liquid, pasty or semisoft form.

The principles of the present invention will be apparent from the schematic view shown in FIG. 1. From this Figure it will be apparent that a conveyor 11 displaceable in the direction of the arrow x is provided with rows of receptacles each receiving a respective cup 12.

Prior to reaching the discharge station represented at A in FIG. 1, the machine, represented at 10, is provided with a cup-supply station at which the individual cups 12 are deposited in the receptacles of the conveyor belt 11, a pre-dosing station, if desired, at which fruit or other portions of the comestible product are introduced into the cups, a main filling station in which all or the balance of the comestible is deposited in each cup, a lid-applying station at which each cup is closed by a respective cover lid, and a printing station in which indicia of the shelf life of the product or its distribution date can be applied to the closed cup. Such stations are conventional in the art and, being no part of the present invention, have not been described in detail.

The cups 12 are disposed in transverse rows $R_y$ and in longitudinal rows $R_x$, the latter running parallel to the direction of displacement of the conveyor 11 and the direction of advance of the cups represented by the arrow x.

It also will be apparent from FIG. 1 that during the earlier operations, the cups are spaced apart from their nearest neighbors by relatively large distances to accommodate the various devices for filling and the like.

At the discharge station A, there is provided a cup-takeup device 13 which has been represented diagrammatically and the details of which will be apparent from the other Figures of the drawing to be subsequently described. The pickup device 13 is disposed along the path of the conveyor 11, i.e. at the downstream end thereof in the longitudinal or feed direction x.

The device is, when the cups are to be disposed in substantially rectangular holders or lifters, cardboard boxes or pallets, intended to take up a rectangular array of cups, e.g. 20 in the illustrated case, namely the cups within the outline G, and reduce size of this array as shown to the left of the outline G and deposit the picked-up array of cups upon a conveyor Q which is displaceable in the direction of the arrow $q_y$, i.e. transverse or perpendicular to the feed direction x. In other words, the device 13 not only lifts the cups from the conveyor 11, but transfers the lifted cups to a conveyor Q and hence permits the cups to pass in a L-shaped pattern from the conveyor 11.

As has already been noted, the cups 12 on the conveyor 11 have a relatively large spacing from the nearest neighbor cups, i.e. each cup is spaced from the cups disposed transversely thereof in the direction $R_y$ and from the cups on opposite longitudinal sides thereof in the direction of the arrow x, by relatively large distances.

In picking up the cups, however, the device 13 condenses the array to the smaller array shown in broken lines L by causing the outer parts of the array on both the long and short sides of the rectangle to move toward the center thereof. The cups can thus be concentrated in a so-called cup block B so that they can be received in a lifter or holder 14 which has also been shown diagrammatically in FIG. 1.

FIG. 1 does not, however, show the grippers of the cup-pickup device 13, it being understood that the grippers, in transferring the cups from the array G to the array L, bring about this condensation of the array by moving closer together and toward the center of the array.

The transverse conveyor Q can be any conventional device for carrying off the assembled block of filled cups.

FIGS. 2 through 7 show the apparatus 10 and particularly the cup-pickup device 13 in somewhat greater detail.

Figure 2:
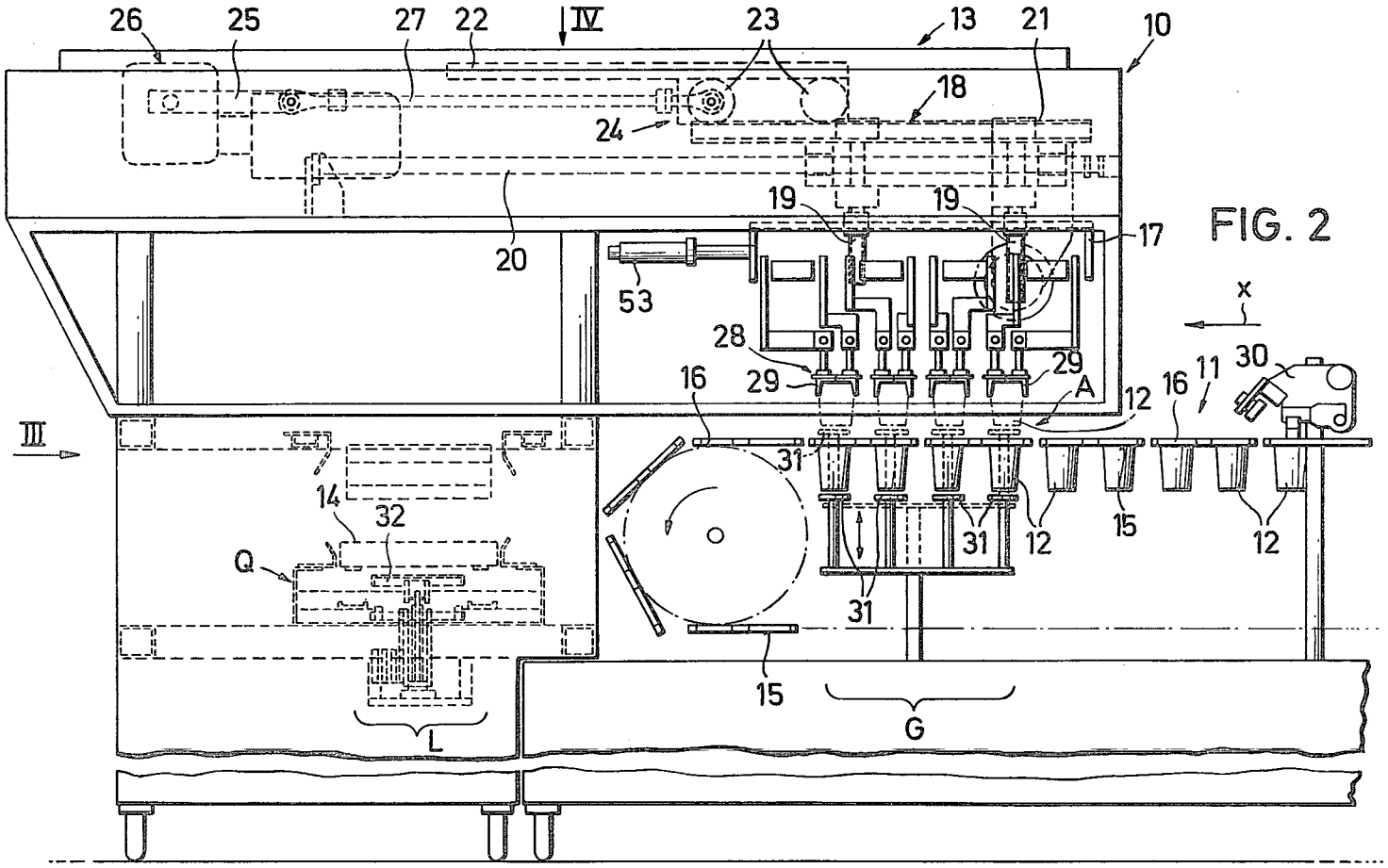
FIG. 2 is a somewhat diagrammatic and partial side elevational view thereof.

For example, in FIG. 2 it is apparent that the conveyor 11 comprises a multiplicity of cell plates 15, each of which is formed with an opening constituting a receptacle for a respective cup 12. The openings in the cell plates 15 are of a cross section of the outer periphery of the cup 12. When the cups 12 are of slightly tapered circular cross section, the receptacle openings 15 can be circular openings.

The cup receptacles 16 are (see FIG. 1) disposed in transverse rows $R_y$ and in longitudinal rows $R_x$. The chain formed by the cell plates 15 can pass around a drum or roller of the conveyor at the discharge station so as to be returned to the opposite end of the machine at which the cups are introduced into the openings 16 of the cell plates 15 as they ride to the upper stretch or path of the conveyor chain.

The apparatus also comprises a transport frame 18 which carries adjustable spindles 19 upon which a holder frame 17 is vertically displaceable.

On its upper side, the transport frame 18 is provided with two racks 21 having upwardly turned teeth. Disposed above the racks 21, are two racks 22 mounted upon the machine housing and having downwardly turned teeth. Each of the racks 22 is vertically aligned or lies in a common vertical plane with one of the lower racks 21.

Between each pair of coplanar racks 21, 22, there is disposed a pinion 23 in meshing relationship with both racks. The pinions 23 are mounted upon a gear carriage 24.

A crank arm 25 driven by an electric rotor 26 through a transmission or stepped-down gearing system is connected to the carriage 24 by a rod 27 pivotally connected to the carriage 24 and to the crank arm 25.

Because of the meshing relationship of the gears 23 with the fixed rack 24 and the rack 21 on the transport frame 18, a linear movement of the carrige 24 will result in a linear displacement of the frame 18 of twice the stroke in the same direction as the carriage displacement. Thus the mechanism 21–27 is able to impart a back-and-forth movement to the transport frame.

This construction of the reciprocating drive for the frame 18 results in a reduced length of the apparatus 10 by comparison to a drive system in which a fluid-pressure cylinder is connected directly to the transport frame for reciprocating it. The transport frame 18 is provided with guide rollers 54 which support the transport frame on horizontal guide rails 20 mounted on the machine housing.

The grippers 28, which are carried by the holder frame 17, each comprise a pair of gripper halves 29. In FIG. 2, the grippers 28 are shown in their gripping positions G in engagement with cups 12 designated in dot-dash lines.

Previously, the filled cups were carried by means of the cell plates 15 of the conveyor 11 to the discharge station A. The last working station ahead of the discharge station A is a printing station in which a printing head 30 applies the indicia to each cup designating the last sale date.

Each time, when four transverse rows of cups corresponding to the last four transverse rows $R_y$ are disposed at the discharge station A, the cup lifter plates 31 are displaced upwardly (broken lines in FIG. 2) through the receptacles 16 to lift the twenty cups into the open grippers 28. The gripper halves 29 of the grippers 28 then close upon the cups in the direction of the arrow x, whereupon the lifter plates are lowered to the position shown in solid lines.

Using the aforedescribed drive, the holder frame 17, together with all of its grippers 28, in the case shown twenty in number, is displaced from the pickup location G into the position L. Shortly before reaching this position or during the displacement of the frame 17, the grippers 28 undergo movement in two mutually perpendicular directions to concentrate the twenty cups 12 to the cup block B as has been described with respect to FIG. 1.

From FIG. 2 it will also be apparent that the transverse conveyor Q (for example a flight conveyor) can be traversed by a lifting platform 32. In FIG. 2, the lifting platform 32 has been shown in its lower position. However, the platform is disposed to raise the holder 14 into a takeup position in which the holder engages the entire block B from below as soon as the grippers 28 are disposed in the position L. The gripper halves 29 are thereupon opened and the cups 12 carried by the holder 14 which is then lowered onto the flight conveyor Q. The container unit is thereupon carried away.

Figure 7:
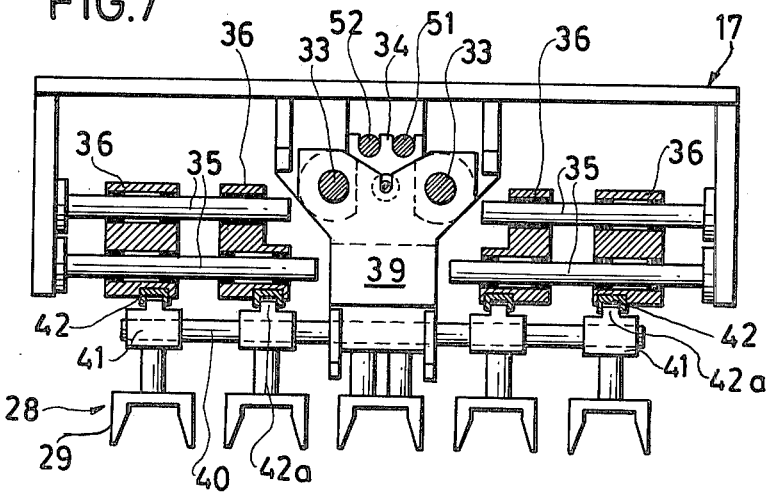
FIG. 7 is a cross-sectional view taken along the section line VII—VII of FIG. 6.
Figure 3:
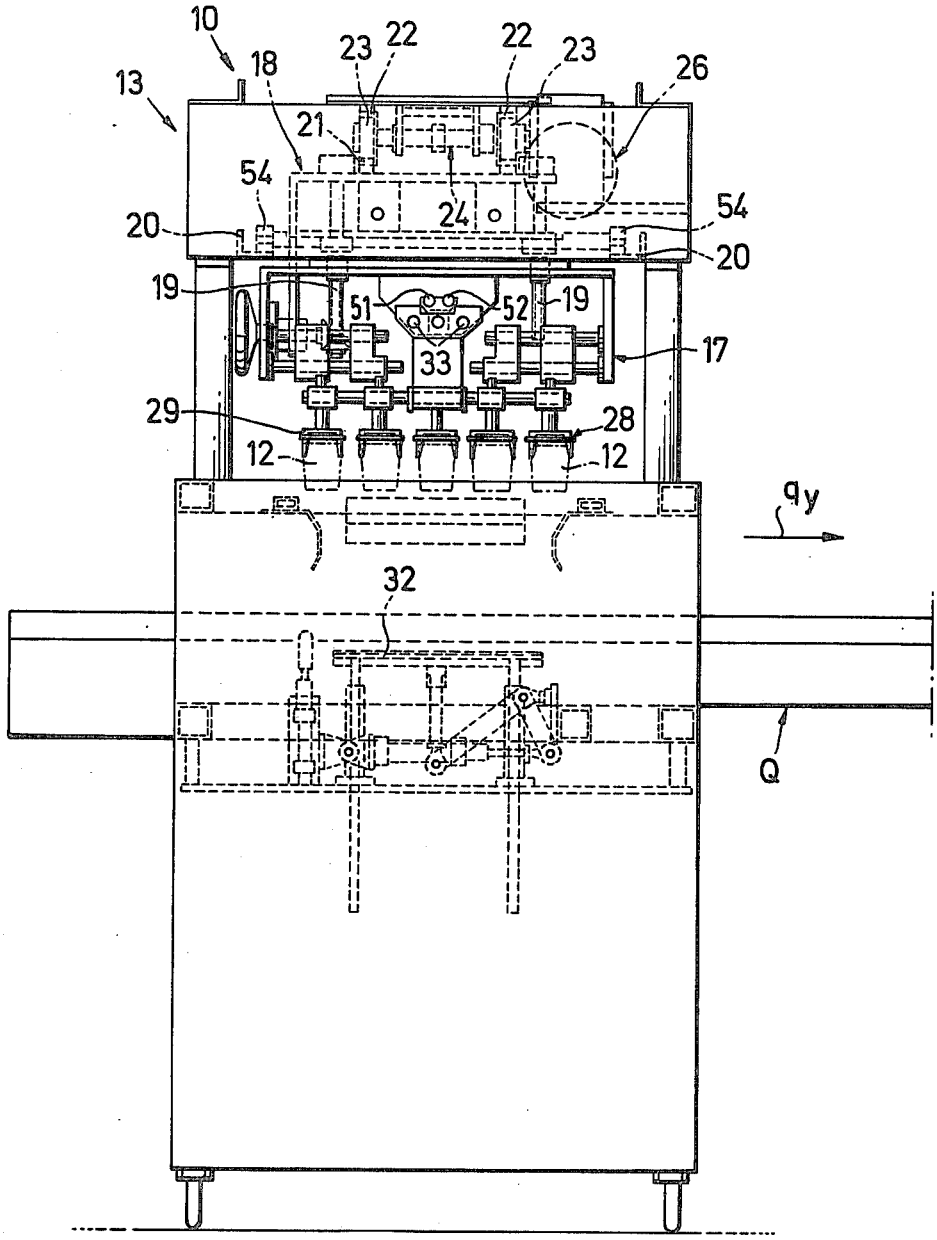
FIG. 3 is a partial rear view of the apparatus taken in the direction of the arrow III of FIG. 2.
Figure 4:
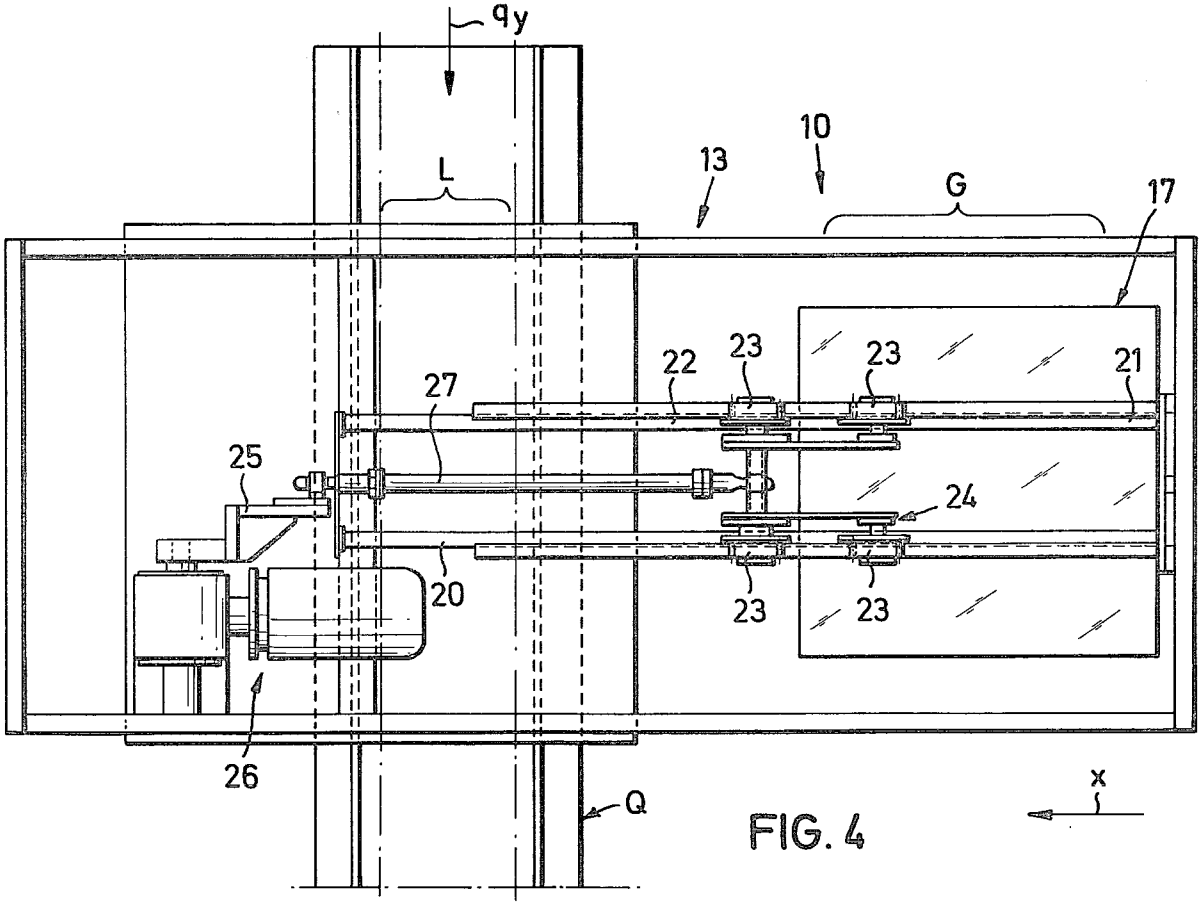
FIG. 4 is a partial plan view taken in the direction of the arrow IV of FIG. 2 and illustrating some of the details of the drive of the transport carriage of the present invention.

FIGS. 3 and 4 show in other views the structure previously described in connection with FIG. 1 and should be considered in conjunction with the detailed description below, also referring to FIGS. 5–7, of the gripper displacing means.

The support frame 17 (FIGS. 3 and 5–7) is provided with a pair of main guide bars 33 which extend in the feed direction x parallel to the back-and-forth movement of the support frame 17. Gripper holders 34 are slidably mounted upon the main guide bars 33. On both sides of the main guide bars 33, the frame 17 is formed with inwardly extending auxiliary guide bars 35 running at right angles to the main guide bars 33. The auxiliary guide bars 35 carry guide blocks 36 which are axially shiftable on the auxiliary bars and to which the grippers 28 are connected for movement with the guide bars.

The gripper holders 34 which are slidable on the main guide bars 33 are actuated to move along the latter by fluid-pressure double-acting cylinder units 37.

On the two piston-rod ends 38 of each of the double cylinder units 37 there is provided a respective holding arm 39. Each of these arms 39 is connected centrally to a gripper guide bar 40 upon which slide bushings 41 are mounted. The slide bushings 41 are, in turn, engaged by the guide block 36 (see especially FIG. 7). Thus the gripper halves 29 are each disposed in a respective gripper-half row lying at right angles to the main guide bars 33. The individual gripper half rows extend parallel to the rows $R_y$ (see FIG. 1).

The guide bars 36 carry downwardly open U-shaped guide shoes 42 in which the slide bushings 41 of the gripper halves 29 engage with their upwardly extending guide projections 42*a*. This enables the movable connection between the guide block 36 and the gripper halves 29 so that the gripper halves 29 can be displaced upon the gripper guide bars 40 parallel to the transverse rows $R_y$.

When the grippers 28 are disposed in the engaging position G, the guide blocks 36 are relatively widely spaced apart upon the auxiliary guide bar 35.

The guide blocks 36 which are furthest away from the main guide bars 33 are displaced toward and away from the main guide bars 33 transversely thereto by a drive described in greater detail below.

The aforementioned outer guide blocks 36 are adapted to engage, after a lost motion, the guide blocks 36 closest to the main guide bars 33. Further inward displacement of the outer guide blocks 36 entrains the inner guide blocks 36 toward the center of the array.

To this end, abutment members 43, 43*a* are provided on an abutment rod 44 (see FIG. 6), the rods 44 being fixed on the support frame 17.

The slide blocks 36 are shiftable relative to the abutment rods 44, however. In addition, the guide blocks are provided with a pressure and entrainment rod 45. The free end of the latter rod 45 forms a sliding shank within the inner guide block 36, in each case, this shank having an abutment 46.

Figure 6:
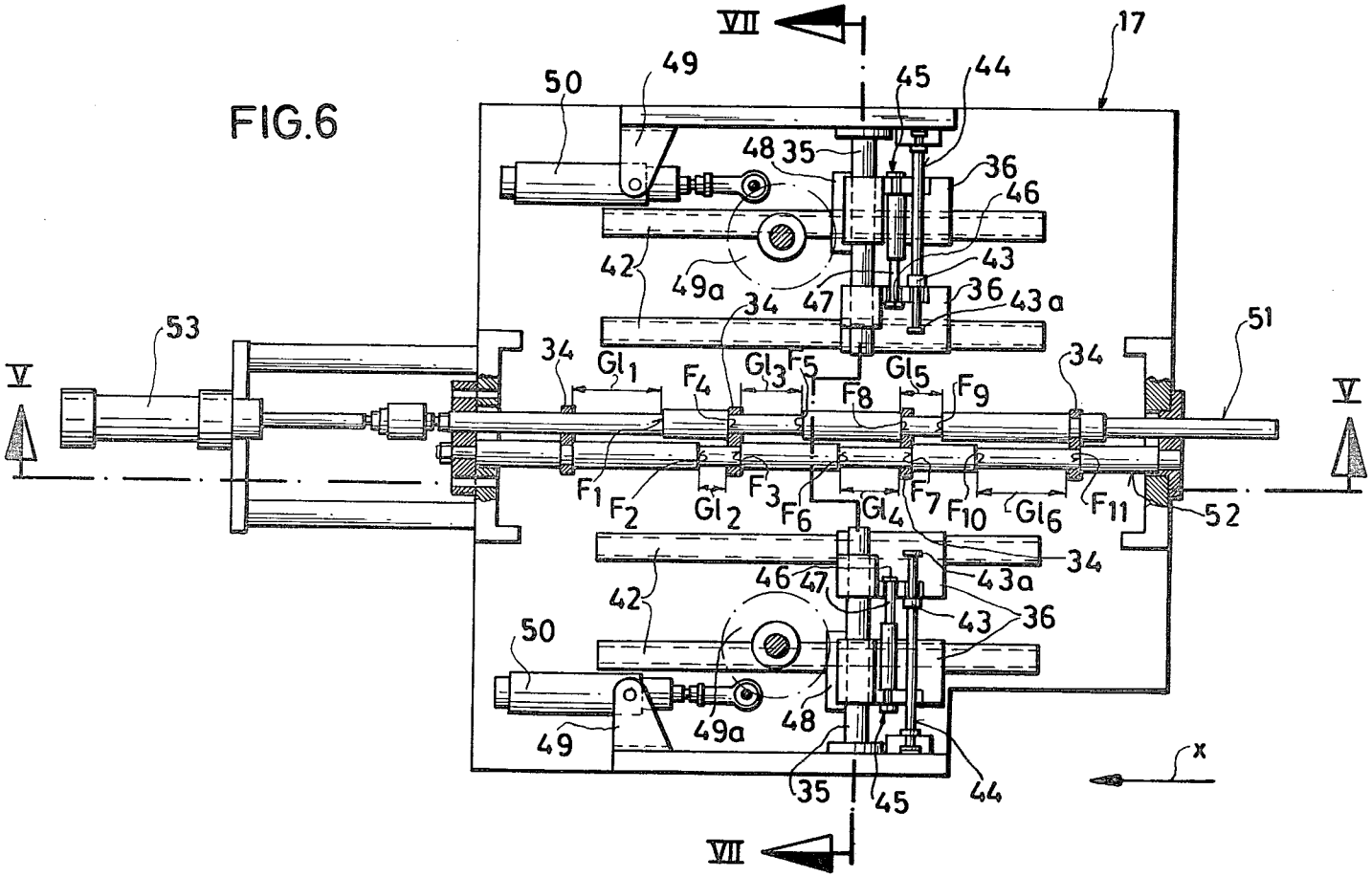
FIG. 6 is a plan view of the mechanism shown in FIG. 5 taken in the direction of arrow VI thereof.

Each outer guide block 36 is provided on its outer side with a rack 48 which is in mesh with a pinion 49*a* rotatable about a fixed axis on the frame 17 and shown only in broken lines in FIG. 6. The periphery of the pinion 49*a* is pivotally connected to a rod forming the piston rod of a pneumatic cylinder 50 which in turn is swingably mounted on a gudgeon 49.

Figure 5:
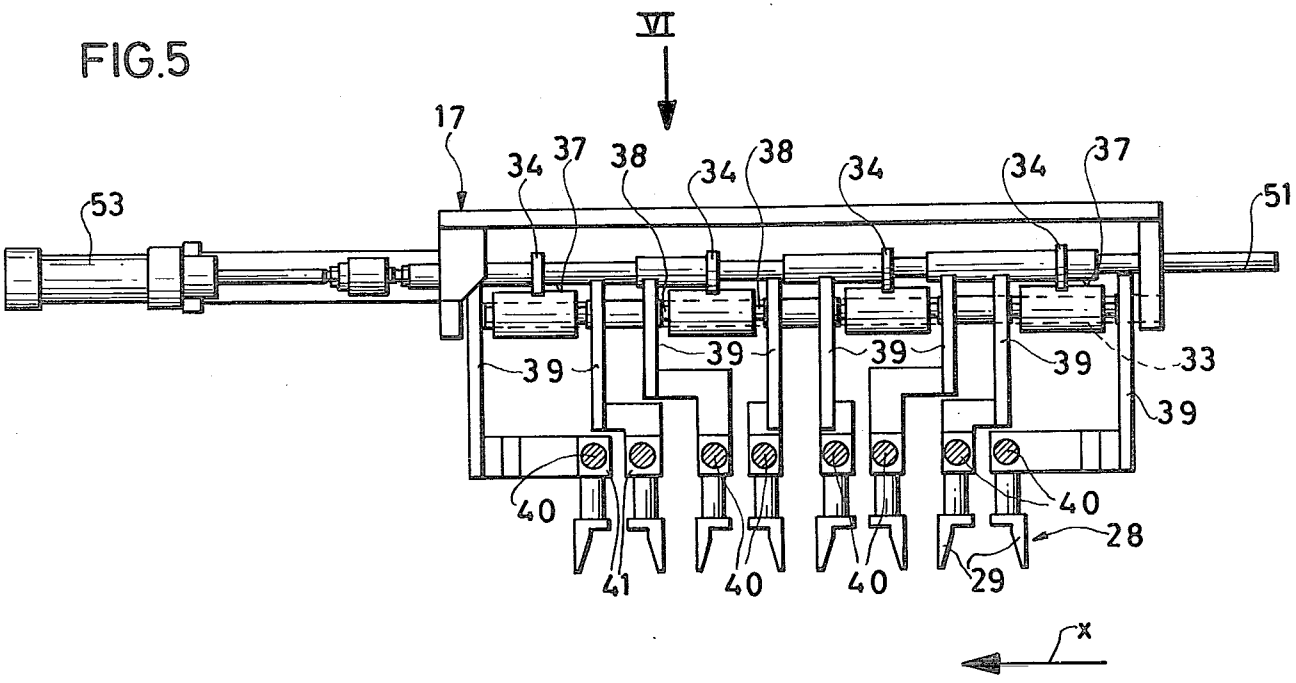
FIG. 5 is an enlarged detail view of the region illustrated in FIG. 2 of the mechanism corresponding to a section taken along the line V—V of FIG. 6.

To simplify the drawing, only a single main guide bar 33 has been shown in FIG. 5 and in FIG. 6 the main guide bar 33 as well as the double cylinder units 37 have not been illustrated. In FIG. 7, the double cylinder units 37 have not been shown and various other elements may have been omitted from one or more of FIGS. 5–7, although shown in the others, when these elements are not important to an understanding of the relationships of the moving parts actually illustrated in these Figures.

Each gripper holder 34 carries a row of grippers extending transversely to the main guide bar 33 and parallel to the rows $R_y$.

A positioning rod 52, fixed to the holder frame 17, extends parallel to a drive rod 51 (see FIGS. 5 and 6).

The drive rod 51 and the positioning rod 52 form slide sections $Gl_1$–$Gl_6$, each of which is limited on one side by an abutment $F_1$–$F_{11}$.

For example, the slide section $Gl_1$ is limited upon the drive rod 51 only on one side by the abutment $F_1$ while, for example, the slide section $Gl_4$ of the positioning rod 52 is limited by the abutments $F_6$ and $F_7$ (FIG. 6).

The gripper holders 34 are each slidable upon a respective such slide section. To this end, the gripper holder 34 disposed to the left in FIG. 6 is fixed to the positioning bar 52 but surrounds the slide section $Gl_1$ and slidably receives the latter section of the drive bar 51. The gripper holder 34 at the extreme right hand side of FIG. 6 is fixed to the drive rod 51 and slides upon the section $Gl_6$ of the positioning rod 52. The remaining gripper holders 34 are slidable upon both the drive rod 51 and the positioning rod 52.

The lengths of the slide sections which are axially spaced from one another on the drive rod 51 and the positioning rod 52 progressively decrease in opposite directions.

The values of the slide-section lengths directly associated with each gripper holder are constant. For example, the total slide section length of the outer left gripper holder 34 of FIG. 6, corresponding to the glide section $Gl_1$, can be considered to have a value 1.5. The outer right gripper holder 34 (FIG. 6), is associated only with the single slide section $Gl_6$ which also has a length value of 1.5. However, the slide section $Gl_2$ will then have a length value of 0.5 and the slide section $Gl_3$ a length value of 1 so that the total slide section length of the associated gripper holders 34 has the constant value 1.5. The slide section $Gl_5$ (with the value 0.5) and the slide section $Gl_4$ (with the value 1) likewise represent a total slide section length with the constant value 1.5.

Because of the aforedescribed configuration of the drive rod 51 and the positioning rod 52, the displacement of the drive rod 51 to the left by the fluid pressure cylinder 53 carried by the frame 17 will result in a successive displacement of the gripper rows with pickup of each inner gripper row as each lost motion is taken up. This movement is effected in the direction of the arrow x, i.e. along the rows $R_x$ (compare FIG. 1). As a result, the grippers are closed together in the direction x. The grippers are closed together in the direction $R_y$ by the cylinder units 50. The opening and closing movements of each gripper are effected via the double cylinder units 37.

In both end states of the gripper array, i.e. in the end stage G as well as in the end state L, both central gripper holders 34 are retained between abutments so that during the opening and closing movements of the gripper halves, by means of the double cylinder units 37, no undesired reaction displacements of the gripper holders can occur.

While the operation of the device has been described in connection with FIG. 1, it may be reviewed by pointing out that, when the frame is in its extreme right-hand position (FIG. 2) and the individual grippers 28 are open, the cups can be raised into the mouths of these grippers, whereupon the individual gripper halves 29 are closed upon the respective cups by the cylinder units 37 described primarily in connection with FIG. 5.

Thereafter, the frame 17 is displaced to the left (via the motor 26 in the manner described primarily in connection with FIG. 2).

During this leftward displacement or at the end thereof, the cylinders 50 and 53 are operated to condense the array of grippers as has been described in connection with FIGS. 5–7, whereupon the double cylinder units 37 are again actuated to release the cups into the holder or support 14.

I claim:

1. In an apparatus for the filling of cups wherein a succession of cups is displaced in a rectangular array on a conveyor to a cup discharge station, and respective cup lifters are provided at the discharge station to raise the cups into respective grippers adapted to remove the cups from the conveyor, the improvement wherein the grippers are provided in a rectangular array of rows extending parallel to the direction of displacement of the conveyor and rows transversely thereto on a support, each of said lifters is aligned with a respective gripper at such discharge station, and said support is provided with means for displacing said grippers in two direction at right angles to one another to shift said grippers toward and away from one another in said directions to condense said array, each of said grippers including a pair of gripper halves reaching downwardly toward said lifters and provided with means for displacing said gripper halves toward and away from one another in one of said directions, said support being displaceable between a position wherein said grippers are aligned with said lifters and a position in which said cups are to be released with a reduced spacing from that of the cups on said conveyor, said support being provided with a pair of main guide bars extending in the direction of displacement of said support, gripper holders slidably mounted on said main guide bars and carrying said grippers, auxiliary guide bars fixed to said support and extending inwardly from opposite edges thereof at right angles to said main guide bars, and guide blocks slidable on said auxiliary guide bars and coupled with said grippers for displacing same transversely to said main guide bars.

2. The improvement defined in claim 1 wherein said conveyor is formed with throughgoing receptacles each adapted to receive a respective one of said cups, said lifters comprising respective lifting plates and means for displacing said plates through said receptacles of said conveyor.

3. The improvement defined in claim 1 wherein said support is provided with a linearly shiftable drive bar movable parallel to said main guide bars and connected with said gripper holders for displacing same back and forth to alternately enlarge and condense the array of grippers.

4. The improvement defined in claim 3, further comprising a positioning bar on said support parallel to said drive bar, said drive bar and said positioning bar defining respective slide sections forming abutments with the respective gripper holders for the entrainment for said gripper holders successively with lost motion between them.

5. The improvement defined in claim 4 wherein the lengths of the axially spaced slide sections of the drive and positioning bars decrease in steps opposite one another.

6. The improvement defined in claim 1 wherein the grippers are displaced toward the center of said array relative to the respective gripper holders in a direction perpendicular to said main guide bars with lost motion.

7. The improvement defined in claim 1 wherein said support is a holder frame displaceable horizontally and provided with means for displacing the holder frame, the means for displacing said frame comprising a transport carriage shiftable horizontally parallel to said frame and disposed thereabove, and vertically adjustable means connecting said frame to said carriage.

8. The improvement defined in claim 1 wherein said support is displaceable at right angles to the direction of advance of said conveyor.

9. In an apparatus for the filling of cups wherein a succession of cups is displaced in a rectangular array on a conveyor to a cup discharge station, and respective cup lifters are provided at the discharge station to raise the cups into respective grippers adapted to remove the cups from the conveyor, the improvement wherein the grippers are provided in a rectangular array of rows extending parallel to the direction of displacement of the conveyor and rows transversely thereto on a support, each of said lifters is aligned with a respective gripper at said discharge station, and said support is provided with means for displacing said grippers in two directions at right angles to one another to shift said grippers toward and away from one another in said directions to condense said array, said support being displaceable between a position wherein said grippers are aligned with said lifters and a position in which said cups are to be released with a reduced spacing from that of the cups on said conveyor, said support being provided with a pair of main guide bars extending in the direction of displacement of said support, gripper holders slidably mounted on said main guide bars and carrying said grippers, auxiliary guide bars fixed to said support and extending inwardly from opposite edges thereof at right angles to said main guide bars, and guide blocks slidable on said auxiliary guide bars and coupled with said grippers for displacing same transversely to said main guide bars, said gripper holders being provided with double-acting double cylinder units having axes parallel to the main guide bars, respective piston rods on each of said cylinders, respective holding arms connected to each of said piston rods, respective gripper guide rods connected to each of said arms, respective guide bushings slidable on each of said gripper guide bars and connected to respective guide blocks for movement relative thereto, each of said grippers having a respective gripper half connected to the respective guide bushing whereby said double cylinder units open and close each of said grippers.

10. The improvement defined in claim 9 wherein each of said guide blocks has a downwardly open generally U-shaped guide rail, each of said bushings having an upwardly turned guide projection received in said rail.

11. In an apparatus for the filling of cups wherein a succession of cups is displaced in a rectangular array on a conceyor to a cup discharge station, and respective cup lifters are provided at the discharge station to raise the cups into respective grippers adapted to remove the cups from the conveyor, the improvement wherein the grippers are provided in a rectangular array of rows extending parallel to the direction of displacement of the conveyor and rows transversely thereto on a support, each of said lifters is aligned with a respective gripper at said discharge station, and said support is provided with means for displacing said grippers in two directions at right angles to one another to shift said grippers toward and away from one another in said directions to condense said array, said support being displaceable between a position wherein said grippers are aligned with said lifters and a position in which said cups are to be released with a reduced spacing from that of the cups on said conveyor, said support being provided with a pair of main guide bars extending in the direction of displacement of said support, gripper holders slidably mounted on said main guide bars and carrying said grippers, auxiliary guide bars fixed to said support and extending inwardly from opposite edges thereof at right angles to said main guide bars, and guide blocks slidable on said auxiliary guide bars and coupled with said grippers for displacing same transversely to said main guide bars, said support being provided with a linearly shiftable drive bar movable parallel to said main guide bars and connected with said gripper holders for displacing same back and forth to alternately enlarge and condense the array of grippers, a positioning bar being provided on said support parallel to said drive bar, said drive bar and said positioning bar defining respective slide sections forming abutments with the respective gripper holders or the entrainment for said gripper holders successively with lost motion between them, and an outer gripper holder of the array is fixed relative to said main guide bars while the opposite outer gripper holder is displaceable toward the fixed gripper holder, the remaining gripper holders being disposed between the outer gripper holders, said outer gripper being connected to said drive bar and displaceable thereby whereby, upon displacement of said outer gripper holder, the inner gripper holders are successively entrained toward the fixed gripper holder.

12. In an apparatus for the filling of cups wherein a succession of cups is displaced in a rectangular array on a conveyor to a cup discharge station, and respective cup lifters are provided at the discharge station to raise the cups into respective grippers adapted to remove the cups from the conveyor, the improvement wherein the grippers are provided in a rectangular array of rows extending parallel to the direction of displacement of the conveyor and rows transversely thereto on a support, each of said lifters is aligned with a respective gripper at said discharge station, and said support is provided with means for displacing said grippers in two directions at right angles to one another to shift said grippers toward and away from one another in said directions to condense said array, said support being displaceable between a position wherein said grippers are aligned with said lifters and a position in which said cups are to be released with a reduced spacing from that of the cups on said conveyor, said support being provided with a pair of main guide bars extending in the direction of displacement of said support, gripper holders slidably mounted on said main guide bars and carrying said grippers, auxiliary guide bars fixed to said support and extending inwardly from opposite edges thereof at right angles to said main guide bars, and guide blocks slidable on said auxiliary guide bars and coupled with said grippers for displacing same transversely to said main guide bars, the gripprs being displaced toward the center of said array relative to the respective gripper holders in a direction perpendicular to said main guide bars with lost motion, outer guide blocks of said array being provided with racks for the displacement of said guide blocks inwardly, each of said racks being engaged by a respective pinion rotated by a fluid-pressure cylinder mounted on said support.

13. In an apparatus for the filling of cups wherein a succession of cups is displaced in a rectangular array on a conveyor to a cup discharge station, and respective cup lifters are provided at the discharge station to raise the cups into respective grippers adapted to remove the cups from the conveyor, the improvement wherein the grippers are provided in a rectangular array of rows extending parallel to the direction of displacement of the conveyor and rows transversely thereto on a support, each of said lifters is aligned with a respective gripper at said discharge station, and said support is provided with means for displacing said grippers in two directions at right angles to one another to shift said grippers toward and away from one another in said directions to condense said array, said support being displaceable at right angles to the direction of advance of said conveyor, said support being formed as a holder frame displaceable horizontally and provided with means for displacing the holder frame, the means for displacing said frame comprising a transport carriage shiftable horizontally parallel to said frame and disposed thereabove, and vertically adjustable means connecting said frame to said carriage, said carriage being provided with a rack having upwardly extending teeth, the apparatus further comprising a fixed rack having downwardly extending teeth disposed above the rack of said carriage and in the same vertical plane therewith, a pinion meshing with both of said racks, and means for linearly displacing the axis of said pinion to impart a reciprocating displacement to said carriage.

14. The improvement defined in claim 13 wherein said carriage is provided with two such racks and two such racks are fixed on the apparatus, respective pinions connecting the fixed racks and the carriage racks, and a further carriage carrying said pinions for linearly displacing the axes thereof.

15. The improvement defined in claim 13 wherein the means for displacing the axis of said pinion includes a crank and an articulated rod connecting the crank to said pinion.

* * * * *